United States Patent [19]

Nagayoshi

[11] 4,271,655

[45] Jun. 9, 1981

[54] SEMIAUTOMATIC-AUTOMATIC STRAPPING MACHINE

[75] Inventor: Katsuhiro Nagayoshi, Yokohama, Japan

[73] Assignee: Nichiro Kogyo Co, Ltd., Yokahama, Japan

[21] Appl. No.: 68,335

[22] Filed: Aug. 21, 1979

[30] Foreign Application Priority Data

May 14, 1979 [JP] Japan ..... 54-63980[U]

[51] Int. Cl.[3] ..... B65B 13/06; B65B 67/08

[52] U.S. Cl. ..... 53/201; 53/589; 53/592

[58] Field of Search ..... 53/399, 582, 589, 592, 53/201; 156/212, 495, 468; 100/25, 33 PB

[56] References Cited

U.S. PATENT DOCUMENTS

| | | | |
|---|---|---|---|
| 2,632,381 | 4/1953 | Buckland | 53/589 X |
| 2,780,986 | 2/1957 | Ritenhour | 100/25 |
| 3,070,001 | 12/1962 | Feldkamp | 100/25 |
| 4,020,756 | 5/1977 | Weiss | 53/589 X |
| 4,155,799 | 5/1979 | Matsushita | 156/495 |

*Primary Examiner*—John Sipos

*Attorney, Agent, or Firm*—Oblon, Fisher, Spivak, McClelland & Maier

[57] ABSTRACT

A semiautomatic-automatic strapping machine can be used in the automatic system as well as in the semiautomatic system. An arch having an arch guide is fitted in a longitudinal gap of a table for its lower part and above said table for its arch part in the automatic system and said arch is disassembled and a band projection guide and a band inserting guide are fitted to said longitudinal gap of said table, at the position of said band projection guide front of said receiving part and said band inserting guide behind said receiving part in the semiautomatic system.

1 Claim, 7 Drawing Figures

SEMIAUTOMATIC-AUTOMATIC STRAPPING MACHINE

BACKGROUND OF THE INVENTION

1. Field of the Invention

The present invention relates to a semiautomatic-automatic strapping machine which can be used as an automatic strapping machine by fitting an arch guide and can be converted to a semiautomatic strapping machine by detaching the arch guide.

2. Description of the Prior Arts

It has been known to provide a band feeding and tightening system in a strapping machine. A semiautomatic strapping machine has been usually required for strapping articles having different sizes whereas an automatic strapping machine has been usually required for strapping articles having the same or similar sizes.

The detail of the semiautomatic strapping machine is wellknown. In the semiautomatic strapping machine, an article is wound by a plastic band fed from a band feeder and the plastic band is tightened and melt-bonded at both ends to provide a packaging. In the automatic strapping machine, a plastic band is automatically fed to an arch guide in a looped condition and it is tightened and melt-bonded.

As one of the conventional band feeding and tightening apparatus, it has been proposed to use an apparatus disclosed in Japanese Utility Model Publication No. 23280/1965, in which a return roller and a feed roller rotated at a high speed in the reverse direction to each other are disposed in spaced relation and rocker rollers are provided to selectively contact with the rollers respectively so as to feed the band at a high speed or to tighten the band.

Sometimes, it is preferable to use a semiautomatic strapping machine whereas sometimes it is preferable to use an automatic strapping machine.

The structure of the semiautomatic strapping machine is quite different from the structure of the automatic strapping machine and the functions of these strapping machines are quite different with each other.

Some users wish to operate the semiautomatic strapping machine as an automatic strapping machine sometimes depending upon sizes and configurations of the articles and other operating conditions, whereas some users wish to operate the automatic strapping machine as a semiautomatic strapping machine.

However, the design of the semiautomatic strapping machine is quite different from the design of the automatic strapping machine and accordingly, it has been difficult to convert them with each other.

SUMMARY OF THE INVENTION

An object of the present invention is to provide a semi-automatic-automatic strapping machine which can be used for strapping by a semiautomatic operation and can be also used for strapping by an automatic operation.

Another object of the present invention is to provide a simple convertible system for exchanging the function of the automatic strapping machine to the function of the semiautomatic strapping machine.

The foregoing and other objects of the present invention have been attained by providing a semiautomatic-automatic strapping machine which comprises a casing; a table having a longitudinal gap for passing a plastic band; a feed roller; a return roller; a band gripper for gripping both ends of the band; a heat-pressing means wherein an arch guide held in an arch holder is fitted to said casing or said table so as to guide said plastic band into said arch guide in the automatic system whereas said arch holder having said arch guide is detached from said casing or said table and a band projection guide is fitted to said longitudinal gap front of said band gripper and a band insertion guide is fitted to said longitudinal gap behind of said band gripper in the semiautomatic system.

BRIEF DESCRIPTION OF THE DRAWINGS:

Various objects, features and attendant advantage of the present invention will be fully appreciated as the same becomes better understood from the following detailed description of the invention when considered in connection with the accompanying drawings wherein the like reference numerals designate identical or corresponding parts throughout several views, in which.

DETAILED DESCRIPTION OF THE PREFERRED EMBODIMENTS

Figure 7:
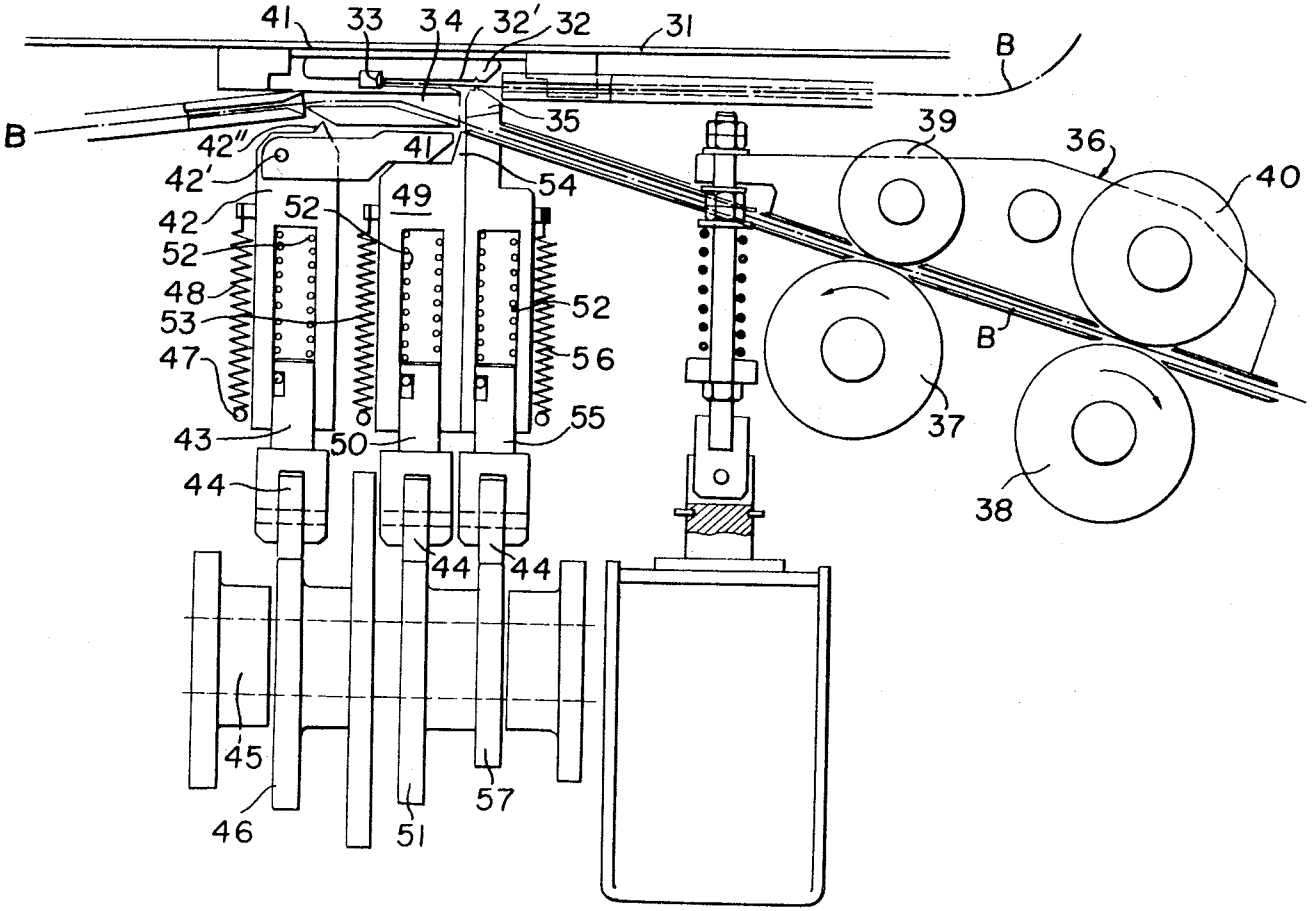
FIG. 7 is a front view of a band feeding and tightening system.

Referring to FIG. 7, one embodiment of the band feeding and tightening system will be illustrated.

In FIG. 7, an article is placed on a table (31); a slide table (32) is used for moving the article from the table (31) after the strapping operation and is movable in the transversal direction and the lower surface (32') of the slide table (32) forms a horizontal surface. A micro-lever (33) is placed to detect a contact of the top of the plastic band (B) with the micro-lever and a feeding of the plastic band (B) is stopped. A center guide (34) is used to guide the plastic band (B) into an arch guide in the automatic system; or a band projection guide in a semiautomatic system; the center guide (34) is movable in the transversal direction. A first gripper (35) is to grip the end of the plastic band (B) between the slide table (32) and the gripper when the plastic band (B) is fed so as to contact with the micro-lever (33). A feeding and tightening mechanism (36) for the plastic band (B) comprises a feed roller (37), a return roller (38). When the band (B) is pressed on the feed roller (37) by a rocker roller (39), the band (B) is fed out. When the band (B) is pressed on the return roller (38) by a rocker roller (40), the band (B) is tightened. A compression plate (41) has flat horizontal surface (41') as its upper surface and is pivoted to the shaft (42') of a compression rod (42). A stopper for the compression plate (41) is adjusted to give an angle $\beta$ for feeding the band (B) by the horizontal surface (41'). The compression rod (42) is hollow and a spring (52) and a leg (43) are kept in it and a roller (44) is connected at a lower end of the leg (43). The roller

(44) is always contacted with the cam ring (46) connected to a cam shaft (45). A tensile spring (48) is fitted between the rod (42) and a pin (47) mounted on a frame. A second gripper (42") is projected at the upper end of the rod (42). The band is gripped between the second gripper (42") and the slide table (32) by the elevation of the rod (42) depending upon the cam ring (46) after tightening the band (B).

The spring (52) is used for the gripping. A cutter plunger (49) has a hollow part and a leg (50) and a spring (52) are kept in the hollow part. A roller (44) connected to the lower end of the leg (50) is contacted with a cam ring (51). A tensile spring (53) actuates to pull down the cutter plunger (49). The upper surface of the cutter plunger (49) is contacted with the compression plate (41). When the plunger (49) is elevated by the cam shaft, the compression plate (41) is pulled up by its upper surface. A cutter (54) is projected upwardly from one side of the plunger (49) and the band (B) is cut between the cutter and the side surface of the first gripper (35). The first gripper (35) has a hollow part and a spring (52) and a leg (55) are kept in the hollow part. A roller (44) connected to the lower end of the leg (55) is always contacted with a cam ring (57). A tensile spring (56) is fitted.

Although one embodiment of the band-feeding and tightening system has been illustrated, it is possible to modify the band feeding and tightening system as desired in view of the conventional structures.

Figure 1:
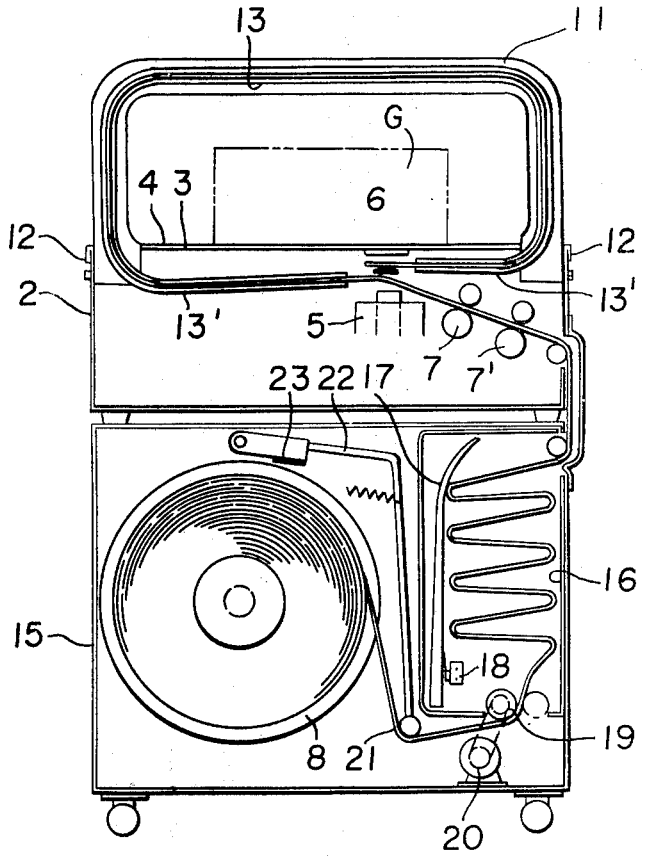
FIG. 1 is a schematic view of a semiautomatic-automatic strapping machine of the present invention in the form of an automatic system.
Figure 2:
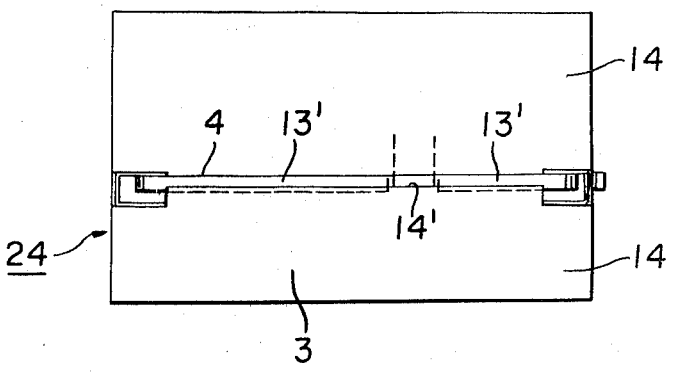
FIG. 2 is a plane view of the strapping machine of FIG. 1.

Referring to FIGS. 1 and 2, one embodiment of the semiautomatic-automatic strapping machine in the form of the automatic system will be illustrated.

A casing (2) is covered by a table (3) having a longitudinal gap (4) for passing a plastic band (B). A heat-pressing part (5) is located in front of the feed roller (7) so as to melt-bond the end of the plastic band (B) overlapped on the other end of the plastic band (B) by pressing and heating the overlapped part of the plastic band (B) between the receiving part (6) and the heat pressing part (5). The feed rollers and the return rollers (7), (7') and a band roller (8) are used for feeding and tightening the plastic band (B). A package (G) is strapped by the plastic band (B). An arch (11) is fitted on the upper side of the casing (2) with a fitting such as a nut and a bolt or a key. The arch (11) has an arch guide (13) which is opened by the tightening force of the plastic band (B) wound along the arch guide. The lower part (13'), (13') of the arch guide (13) has a space (14') in which a band gripper is located. One end of the lower part (13') of the arch guide (13) is adjacent to a center guide (34) as shown in FIG. 7.

In the case of the automatic system, the center guide (34) is connected to the end of the arch guide (13') so as to lead the end of the plastic band (B) into the arch guide (13).

The lower part (13') of the arch guide (13) is put into the casing through the longitudinal gap (4) of the table.

The band roll (8) is held in a casing (15) which can be used as the base of the casing (2). A chamber (16) is formed in the casing (15) so as to store the loosed plastic band (B) having a length for feeding along the arch guide (11). A sensor (17) for detecting the storage of the plastic band (B) is located in the chamber (16). A motor (20) is stopped by detaching a limit switch (18) contacted with the sensor (17) when the sensor (17) is pushed by the plastic band (B). A roller (21) is fitted to a band roll brake arm (22). When the motor (20) is rotated, the roller (21) is pulled up by the plastic band (B) and a brake (23) on the band roll (8) is released.

It is possible to hold the band roll (8) in the casing (2) without using the casing (15). The chamber (16) can be formed in the casing (2).

The semiautomatic operation for strapping the package (G) is the same as the known operation except the arch (11) having the arch guide (13) is detachable through the longitudinal gap (4). Even though the arch (11) having the arch guide (13) is detached, the machine can not be used as a semiautomatic strapping machine. The important feature of the present invention is to convert the automatic system to the semiautomatic system.

In the automatic system the chamber (16) is formed because the plastic band (B) is wound along the arch guide (13) and accordingly, the length of the band (B) for tightening is longer than the length in the semiautomatic system and the band (B) is stored between the tightening roller (7), (7') and the band roll (8) in the loosing condition. The loosed band (B) should be stored in the chamber (16). Moreover, the feeding of the plastic band (B) from the band roll (8) becomes smooth by storing the band (B) having the length for feeding into the arch guide (13).

Figure 3:
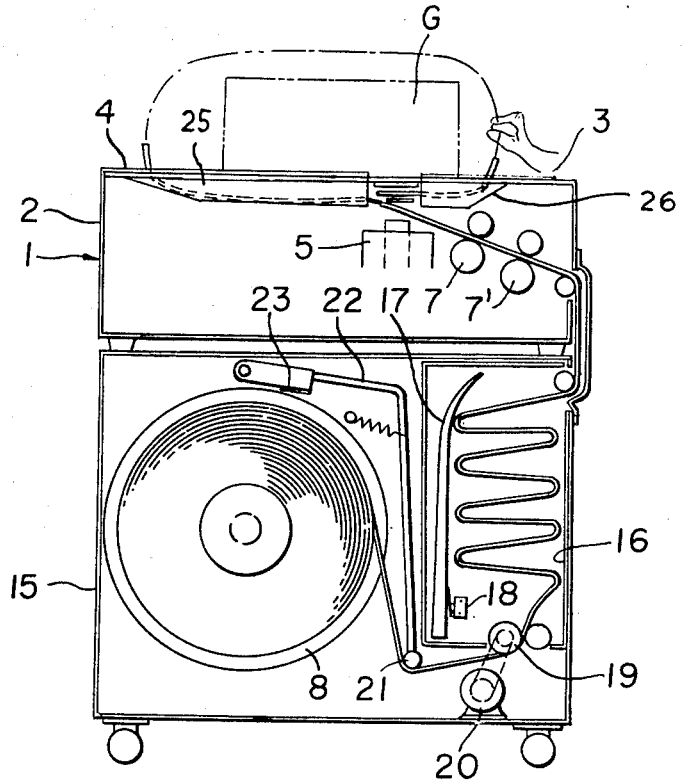
FIG. 3 is a schematic view of the semiautomatic-automatic strapping machine of FIG. 1 in the form of a semiautomatic system.
Figure 4:
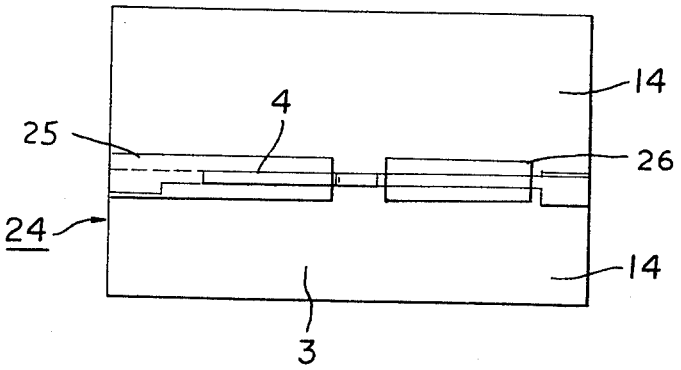
FIG. 4 is a plane view of the strapping machine of FIG. 3.

Referring to FIGS. 3 and 4, one embodiment of the semiautomatic-automatic strapping machine in the form of the semiautomatic system will be illustrated.

The automatic system shown in FIGS. 1 and 2 can be exchanged to the semiautomatic system shown in FIGS. 3 and 4 by detaching the arch (11) having the arch guide (13) by disengaging the fitting (12) and fitting a band projection guide (25) and a band inserting guide (26) to the longitudinal gap. The band projection guide (25) is placed in front of the center guide (34) which is formed below the receiving part (6). The band inserting guide (26) is placed behind the receiving part (6).

The band projection guide (25) and the band inserting guide (26) can be fitted by only putting them in the longitudinal gap (4) of the table (3). In order to prevent slippage of these guides, it is preferable to form fitting parts by forming a projection on one of the guide or the table and a recess on the corresponding position of the other. Such projection (27), (28) or the recess can be formed by simple notching.

Figure 5:
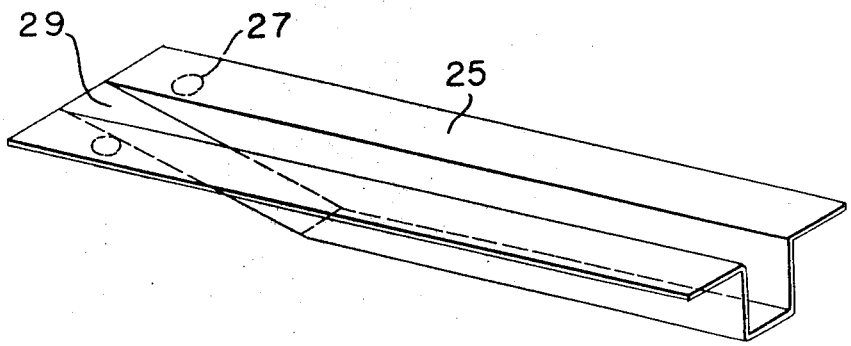
FIG. 5 is a schematic view of a band projection guide.
Figure 6:
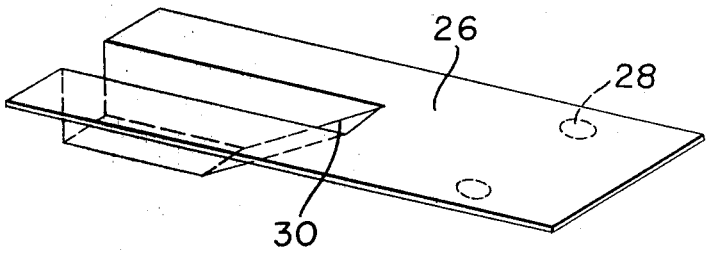
FIG. 6 is a schematic view of a band insertion guide.

The band projection guide (25) having a projection (27) shown in FIG. 5 and the band inserting guide (26) having a projection (28) shown in FIG. 6 can be easily fitted in the longitudinal gap of the table (3) by simply placing them. The falling of the end of the band (B) into the longitudinal gap (4) can be easily prevented by the band projection guide (25). The band projection guide (25) can have a tapered part so as to lead out the end of the band (B) above the table (3). The tapered part (29) can be formed at any suitable position of the band projection guide. The band inserting guide (26) can have a tapered part (30) so as to lead the end of the band (B) into the gripper and between the receiving part (6) and the heat-pressing part (5).

The structure of the band projection guide (25) and the band inserting guide (26) can be modified as desired.

The semiautomatic system shown in FIGS. 3 and 4 can be formed by disassembling the arch (11) having the arch guide (13) by releasing the fitting (12) and fitting the band projection guide (25) and the band inserting guide (26) to the longitudinal gap (4) of the table (3) at the positions.

In the semiautomatic system, the end of the band (B) projected from the band projection guide (25) is pulled out to wrap the article (G) and is inserted through the band inserting guide (26) between the receiving part (6) and the heat-pressing part (5) and in the gripper. The strapping operation can be performed without any arch guide. Any size of the article (G) can be strapped by the hand operation for the wrapping.

It is also possible to employ the mechanism of the feed roller, the return roller, the gripper and the other parts are described in U.S. Pat. No. 4,155,799.

In accordance with the semiautomatic-automatic strapping machine of the present invention, one strapping machine can be used in the automatic system as well as the semiautomatic system. The two way uses of the strapping machine is unthinkably advantageous in the packaging field.

I claim:

1. A convertible automatic-semiautomatic strapping machine comprising:

a casing;

a table in said casing, said table having a receiving part and a longitudinal gap thereon for the passage of a plastic band;

a band feed roller in said casing;

a band return roller in said casing;

a band gripper in said casing;

a heat-pressing means positioned below said receiving part;

a removable arch positionable on said table, said arch including an arch guide having one portion fittable in said longitudinal gap adjacent said receiving part for taking up said band during automatic operation;

means for detachably retaining said arch on said table;

a band projection guide positionable in said longitudinal gap when said arch has been removed for semiautomatic operation, said band projection guide being positioned adjacent said receiving part in the place of said one portion of said arch guide, said band projection guide including a tapered part for projecting the end of said band above said table;

a band inserting guide positionable in said longitudinal gap adjacent said receiving part and opposite said band projection guide, said band receiving guide having a tapered part for inserting the end of said band between said receiving part and said heat pressing means during semiautomatic operation; and means for removably retaining said band projection guide and said band inserting guide in said longitudinal gap.

* * * * *